United States Patent [19]

Tatsutomi et al.

[11] 4,003,358

[45] Jan. 18, 1977

[54] CONTROL SYSTEM FOR CONTROLLING AN AIR-FUEL MIXTURE IN INTERNAL COMBUSTION ENGINE

[75] Inventors: Yasuo Tatsutomi; Toru Maeda, both of Hiroshima, Japan

[73] Assignee: Toyo Kogyo Co., Ltd., Japan

[22] Filed: Aug. 27, 1974

[21] Appl. No.: 501,197

[52] U.S. Cl. ..... 123/136; 261/43; 261/72 R

[51] Int. Cl.[2] ..... F02M 37/02

[58] Field of Search ..... 123/136, 119 D, 119 DB, 123/121; 261/43, 72 R, 69 R

[56] References Cited

UNITED STATES PATENTS

| | | | |
|---|---|---|---|
| 2,965,086 | 12/1960 | Gregory et al. | 123/136 |
| 3,572,659 | 3/1971 | Kizlauskas | 123/136 X |
| 3,610,221 | 10/1971 | Stoltman | 123/136 |
| 3,628,517 | 12/1971 | Soberski | 123/136 |
| 3,690,307 | 9/1972 | O'Neill | 123/136 |
| 3,852,391 | 12/1974 | Hisatomi et al. | 123/97 B X |
| 3,872,848 | 3/1975 | King | 123/119 D X |

*Primary Examiner*—Charles J. Myhre
*Assistant Examiner*—Tony M. Argenbright
*Attorney, Agent, or Firm*—Wenderoth, Lind & Ponack

[57] ABSTRACT

A control system for controlling an air-fuel mixture to a preferable ratio required in an internal combustion engine during any of the engine operating conditions, which preferable ratio is variable in response to the engine operating condition. In one embodiment, the control system is arranged to regulate the amount of fuel, to be jetted into the intake passage leading to at least one combustion chamber of the engine through a main discharge nozzle, in response to the pressure of fuel vapor inside a fuel tank. In another embodiment, the control system is arranged to regulate the amount of fuel, to be jetted into the intake passage through one or both of the low speed port and the idle port, in response to the pressure of fuel vapor inside the fuel tank. The control system is usable in association with an internal combustion engine of any type having a fuel evaporation control system.

8 Claims, 5 Drawing Figures

CONTROL SYSTEM FOR CONTROLLING AN AIR-FUEL MIXTURE IN INTERNAL COMBUSTION ENGINE

Figure 1:
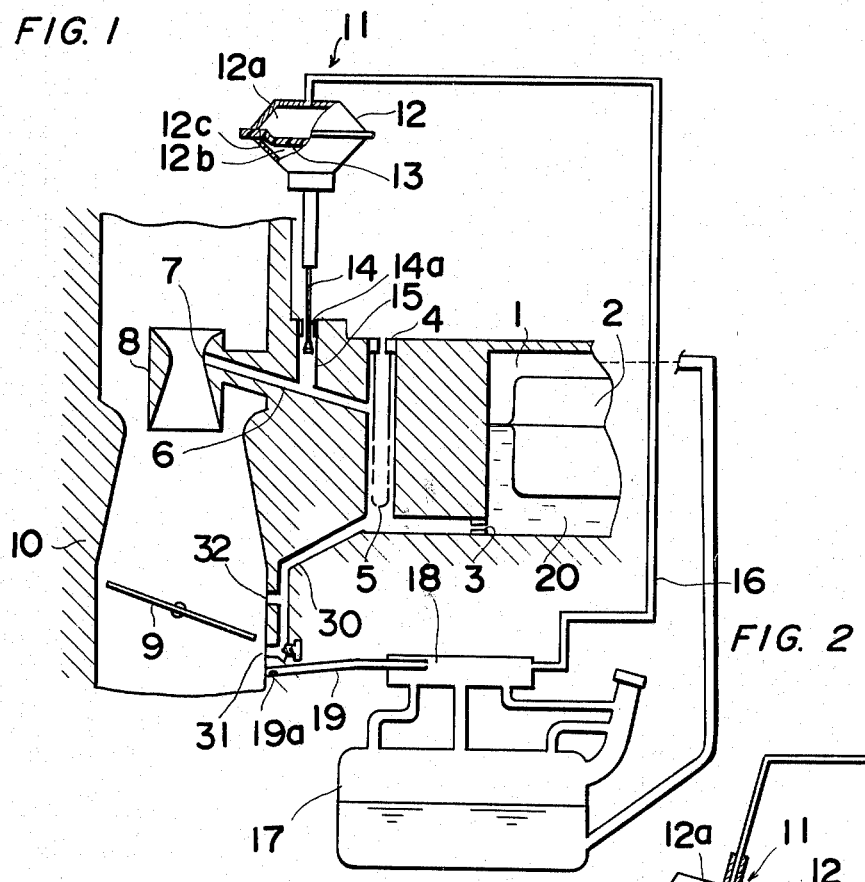

The present invention relates to a fuel supply system in an internal combustion engine and, more particularly, to a control system for controlling an air-fuel mixture in response to the pressure of vaporized fuel within a fuel tank so as to reduce the amount of contaminants released by the internal combustion engine.

The problem of atmospheric pollution has now attracted public attention and various attempts have recently been made in the automobile industry to reduce the amount of the contaminants which are released by an internal combustion engine and which are considered to constitute one of major causes of the atmospheric pollution. The contaminants released by the internal combustion engine are emitted not only through the exhaust system thereof, but also through the fuel supply system thereof.

It is well known that most of the contaminants emitted through the fuel supply system of the internal combustion engine are constituted by fuel vaporized within and leaving a fuel tank. One recent approach to reduce the discharge of fuel vapor from the fuel tank to the atmosphere is the use of a fuel evaporation control system wherein a condensing tank is fluid-coupled to the fuel tank so that the fuel vapor, which has been condensed within the condensing tank, can be fed in part back to the fuel tank and in part to the intake manifold extending between a carburetor and one or more combustion chambers of the internal combustion engine.

According to the conventional fuel evaporation control system of a type referred to above, the handling capacity of the condensing tank is limited and, therefore, if the amount of fuel vapor generated within the fuel tank and subsequently entering the condensing tank is in excess of the handling capacity of the condensing tank, an excess of fuel vapor is fed to the intake manifold. This leads to departure of the final air-fuel mixture ratio from an appropriate value to a small value, wich means an excessively enriched mixture with an increase of the amount of the final mixture to be fed to the engine combustion chamber or chambers. If the excessively enriched mixture or the increased amount of the mixture is supplied to the combustion chambers of the internal combustion engine, not only a relatively great amount of unburned compounds present in the exhaust gases are emitted to the atmosphere through the exhaust system of the engine, but also engine troubles such as failure of smooth engine operation during idling and engine stop will occur.

When it comes to the engine troubles, the same have been experienced when an automotive vehicle is driven where the atmospheric pressure is relatively low, for example, along a mountain pass at an altitude of about 4,000 meters or so. This is because, where the atmospheric pressure is relatively low, the amount of air admitted into the internal combustion engine of the automotive vehicle running at the altitude of, for example, 4,000 meters becomes small and the actual air-fuel mixture ratio accordingly becomes excessively small even though the fuel vapor fed from the fuel tank or the condensing tank admixes with the incoming air-fuel mixture.

According to U.S. Pat. No. 3,572,659, patented on Mar. 30, 1971, a fuel system an internal combustion engine is designed such that, while the fuel tank is communicated to a discharge port for discharging vaporized fuel from the fuel tank into the intake manifold at the downstream side of the throttle valve, the fuel tank is also communicated to a control valve mechanism. The control valve mechanism is disposed in a position to supply air into the intake manifold at the upstream side of the throttle valve in a varying amount regulated in response to the pressure of fuel vapor inside the fuel tank.

In this known arrangement such as disclosed in the above numbered U.S. Patent, the final air-fuel mixture entering the combustion chamber or chambers of the internal combustion can be effectively controlled to an appropriate value even though the vaporized fuel from the fuel tank admixes with the incoming air-fuel mixture from the upstream side of the throttle valve because the air supplied into the intake manifold will be in an amount sufficient to compensate for variation of the ratio of the incoming air-fuel mixture which may take place upon admixture of the incoming air-fuel mixture with the vaporized fuel. However, due to the fact that the control valve mechanism act neither to regulate the amount of fuel to be jetted into the intake manifold through the main discharge nozzle nor through the idle port, the amount of the final air-fuel mixture which subsequently enters the combustion chamber or chambers of the internal combustion engine tends to increase. Therefore, a problem of reducing the contaminants to be emitted through the exhaust system of the engine cannot be solved, and waste of fuel takes place.

Accordingly, an essential object of the present invention is to provide a control system for controlling to appropriate values the ratio and amount of air-fuel mixture which is to be finally fed to one or more combustion chambers of an internal combustion engine of any type, thereby substantially eliminating the disadvantages inherent in the conventional system of a similar kind.

Another important object of the present invention is to provide a control system of the type referred to above, which is capable of maintaining constantly the air-fuel mixture ratio and amount at respectively appropriate values irrespective of variation of the atmospheric pressure under which the engine is operated and also irrespective of variation in pressure of fuel vapor inside the fuel tank or the condensing tank.

A further object of the present invention is to provide a control system of the type referred to above, which is simple in construction and reliable in operation and which does not unreasonably increase the manufacturing cost of an internal combustion engine.

According to one preferred embodiment of the present invention, the control system is designed such as to supply air into a main fuel discharge passage leading from a float chamber to the carburetor venturi so that the final ratio of air-fuel mixture, which may otherwise be enriched excessively by the addition of the vaporized fuel fed from the fuel tank or the conndensing tank into the intake manifold downstream of the throttle valve, can advantageously be adjusted to an appropriate mixture ratio, and concurrently, the amount of the final air-fuel mixture can be adjusted to an appropriate, economical value. To this end, air is adapted to be fed into the main fuel discharge passage to control the amount of emulsion flowing through the main fuel discharge passage, the amount of which air is controlled by a control valve mechanism operable in response to variation of the pressure of the fuel vapor present within the fuel tank. The valve mechanism is also operable in response to variation of the atmospheric pressure.

The control valve mechanism may be an electrically operable one, in which case a transducer means, such as a pressure responsive switch, is required to generate an electric signal indicative of the variation of the pressure of the fuel vapor inside the fuel tank, which electrical signal is used to operate the electrically operable control valve mechanism.

In another preferred embodiment of the present invention, the control valve mechanism is disposed such as to control the flow of emulsion from the float chamber to the idle port so that the final air-fuel mixture, which is ready to be fed into the combustion chambers of the internal combustion engine, can be adjusted on an appropriate value even though the addition of the vaporized fuel destroys the appropriately adjusted initial ratio and amount of the incoming air-fuel mixture prior to mix with the vaporized fuel.

These and other objects and features of the present invention will readily be understood from the following description taken in conjunction with preferred embodiments thereof with reference to the accompanying drawings, in which:

FIG. 1 is a schematic longitudinal sectional view of a carburetor showing a control system disposed on the main fuel discharge passage according to one preferred embodiment of the present invention.

Figure 2:
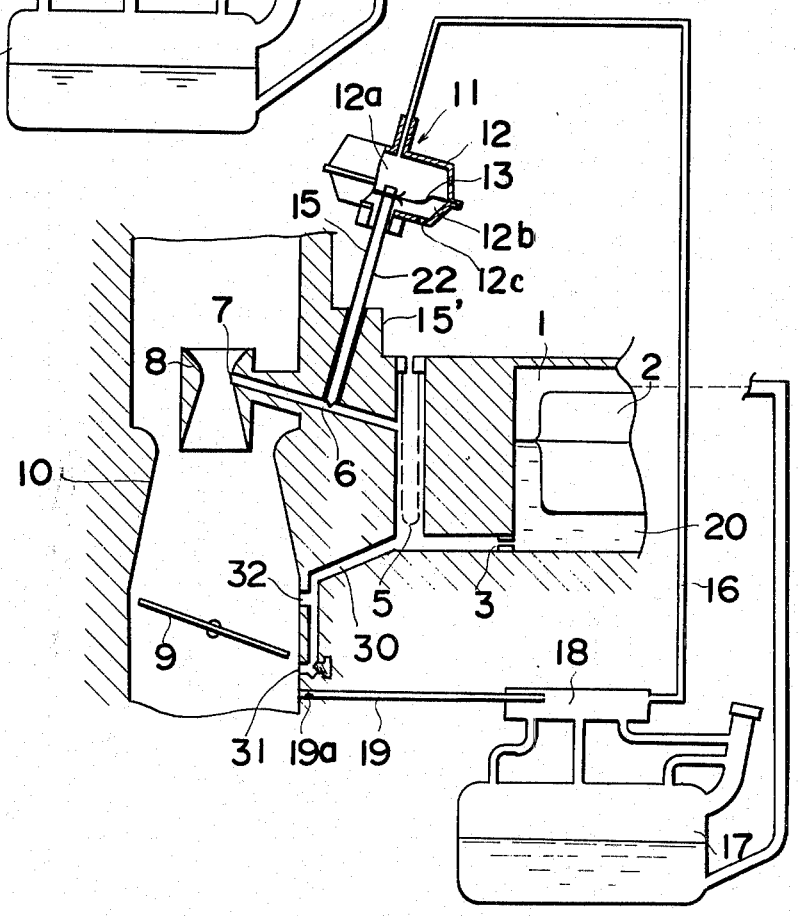
Figure 4:
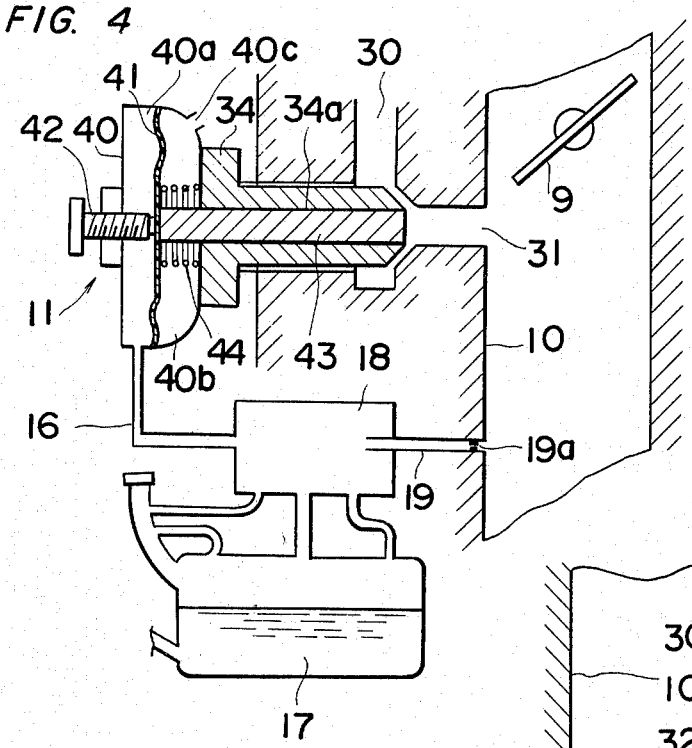
Figure 3:
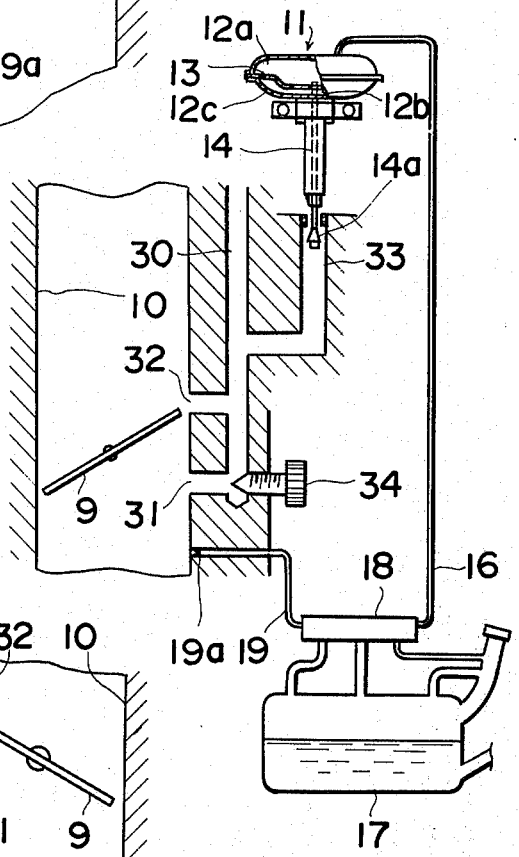
Figure 5:
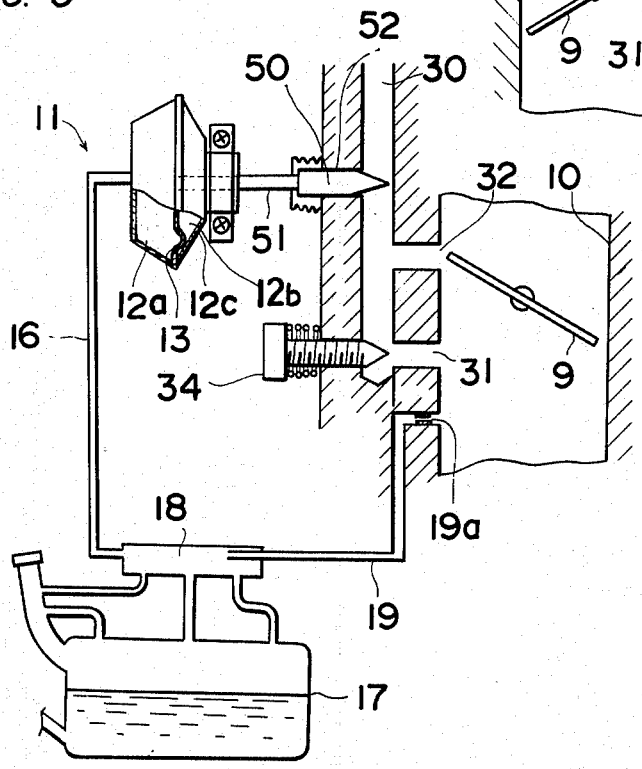

FIG. 2 is a view similar to FIG. 1, showing the control system according to another preferred embodiment of the present invention, FIG. 3 is a schematic longitudinal sectional view of a portion of the carburetor showing a control system disposed in an idle and low speed fuel circuit according to a further preferred embodiment of the present invention, FIG. 4 is a schematic longitudinal sectional view of a portion of the carburetor adjacent an idle adjustment screw showing a control system coupled to the idle adjustment screw according to a still further preferred embodiment of the present invention, and FIG. 5 is a view similar to FIG. 4, showing a modification of the arrangement of FIG. 4.

Before the description of the present invention proceeds, it should be noted that like parts are designated by like reference numerals throughout the accompanying drawings. It is also to be noted that the descriptive terms such as "final air-fuel mixture amount" and "final air-fuel mixture ratio" used in the foregoing and following description and in the appended claims are intended to mean respectively the amount of air-fuel mixture which is ready to be fed into the combustion chambers of an internal combustion engine after having been mixed with vaporized fuel fed to the intake manifold in a manner separate from the fuel fed thereto from the main discharge passage and/or the idle port and which is required to facilitate economical and efficient combustion of the fuel within the combustion chambers during a certain engine operating condition, and the ratio of air to fuel therein.

Referring now to FIG. 1, fuel 20 fed into a float chamber 1 having a float 2 therein from a fuel tank 17 flows through a main jet 3 towards an emulsion tube 5 where the fuel from the float chamber is admixed with air entering into the emulsion tube 5 through an air bleed 4. The emulsion thus prepared subsequently flows through a main fuel discharge passage 6 to a main discharge nozzle 7 from which it is jetted into the interior of a boost venturi 8 concentrically located in a main venturi within an intake passage 10 which extends between a source of air, for example, an air cleaner (not shown) and one or more combustion chambers (not shown) of an internal combustion engine (not shown). A throttle valve 9 is operatively arranged within the intake passage 10 below the boost venturi 8.

The arrangement so far described is well known to those skilled in the art and, therefore, the details thereof are herein omitted for the sake of brevity.

A control system for controlling the air-fuel mixture according to the present invention comprises a control valve mechanism 11 employed in the form of a diaphragm valve assembly 12 having first and second chambers 12*a* and 12*b* divided by a diaphragm member 13. The diaphragm valve assembly 12 includes a piston rod 14 having one end rigidly connected to the diaphragm member 13 and the other end rigidly mounted with a valve piece 14*a* situated within an air bleed 15, which is in communication with the main fuel discharge passage 6, for selectively opening and closing said air bleed 15, a substantially intermediate portion of said piston rod 14 extending through a casing wall of the diaphragm valve assembly 12 in an axially slidable manner.

A fuel tank 17 is shown as including a condensing tank 18 which is in communication with the intake passage 10 through a vapor discharge passage 19 and also in communication with the first chamber 12*a* of the diaphragm valve assembly 12 through a control passage 16. The control passage 16 may be in the form of a passage branched off from the vapor discharge passage 19. The passage 19 has at the end adjacent the intake passage 10 an orifice 19*a* acting to regulate the flow rate of vaporized fuel from the condensing tank 18.

It is well known that as the temperature changes the fuel tank breathes. In other words, as the tank 17 heats up, the air inside the fuel tank 17 expands and, when the fuel tank 17 cools, the air inside it contracts. So long as the fuel tank 17 is heated, fuel within the fuel tank 17 evaporates and the fuel vapor subsequently enters the condensing tank 18 where if the amount of the fuel vapor is within the range of the handling capacity of the condensing tank 18, the fuel vapor can be condensed into liquid fuel which is in turn back to the fuel tank 17. At this time, the valve piece 14*a* is held in position to close the air bleed 15, since the pressure within the control passage 16 is substantially zero.

During this condition, fuel 20 within the float chamber 1 flows through the main fuel discharge passage 6 without being mixed with air, which may be fed through the air bleed 15 if the latter is opened as will be described later, and is then jetted into the boost venturi 8 to attain a predetermined ratio of air-fuel mixture which is in turn fed to the combustion chambers of the internal combustion engine through the throttle valve 9.

On the other hand, if the amount of the fuel vapor is in excess of the handling capacity of the condensing tank 18 and there is an increase in pressure inside the fuel tank 17, the pressure of vaporized fuel is in part fed to the intake passage 10 through the passage 19 and in part to the first chamber 12*a* of the diaphragm valve assembly 12 through the passage 16. Since the pressure applied to the first chamber 12*a* of the diaphragm valve assembly 12 is higher than the atmospheric pressure, the diaphragm member 13 is displaced and, consequently, the piston rod 14 is moved in a direction so as to open the air bleed 15. At this time, air contained in the second chamber 12*b* of the diaphragm valve assembly 12 is expelled to the atmosphere through a hole 12*c* formed in the casing wall of the valve assembly 12. Accordingly, air flowing through the opened air bleed 15 admixes with the fuel passing through the discharge passage 6 towards the boost venturi 8 and, therefore, the amount of the fuel available from the discharge nozzle 7 is reduced to a smaller value than that available when the air bleed would have been closed. This means that the initial air-fuel mixture is made leaner as compared with that during closure of the air bleed 15. Even though the initial air-fuel mixture is made leaner as hereinabove described, the final air-fuel mixture ratio can be maintained at an appropriate value because the vaporized fuel from the discharge passage 19 admixes with the initial air-fuel mixture. Simultaneously, the amount of the final air-fuel mixture can be maintained at an appropriate value.

In the case where the engine is operated, for example, in a mountain of about 4,000 meters in altitude, where the atmospheric pressure is smaller than that at sea level, fuel, that is, gasoline, within the fuel tank 17 is apt to evaporate because of consequent reduction of the evaporation point of the fuel and, therefore, the pressure inside the condensing tank 17 and that inside the fuel tank 18 relatively easily increased. Even under this condition, the control system of the present invention functions in a similar manner as hereinbefore described.

In an embodiment shown in FIG. 2, instead of the use of the valve piece 14*a* and the air bleed 15 which have been described in connection with the foregoing embodiment, a needle valve 22 and a guide bore 15' are employed. The needle valve 22 may be in the form of a piston rod having one end connected to the diaphragm member 13 and the other end radially inwardly tapered, and which is axially slidably accommodated within the guide bore 15' with the tapered end situated in position to regulate the flow rate of emulsion passing through the main discharge passage 6. More specifically, the needle valve 22 acts to vary the cross-sectional area of the main discharge passage 6 in response to variation of the pressure inside the condensing tank 18 or the fuel tank 17, thereby regulating the flow rate of the emulsion.

Though there is a difference in the method of controlling the amount of fuel available from the discharge nozzle 7, the control system according to the embodiment of FIG. 2 functions in a substantially similar manner as that according to the embodiment of FIG. 1.

It is to be noted that a problem associated with the amount of vaporized fuel entering the intake passage 10 from the condensing tank 18 or the fuel tank 17 is serious particularly during low speed and idle operation. Therefore, it is more important that the final air-fuel mixture during low speed and idle operation should not exceed a predetermined mixture ratio more than during other engine operating conditions. This is because a more concentrated air-fuel mixture is required during the low speed and idle operation than during the other engine operating conditions and it has been recognized that unburned compounds present in exhaust gases are emitted to the atmosphere in a greater amount during the low speed and idle operation than during the other engine operating conditions.

In order to avoid excessive enrichment of the final air-fuel mixture with respect to the mixture ratio required during the low speed and idle operation, the following embodiments are provided.

In the embodiment shown in FIG. 3, a known idle and low speed fluid circuit includes an idle and low speed fuel passage 30 leading in a known manner from the float chamber 1 to an idle port 31 and a low speed port 32 arranged in a known manner substantially on opposite sides of the throttle valve 9.

According to the present invention, in order to control the flow rate of fuel flowing through the idle and low speed passage 30, a passage 33 is formed in the carburetor wall portion and has one end communicated to the passage 30 and the other end open to the atmosphere. The valve assembly 12 having a construction as hereinbefore described is arranged in position with the valve piece 14*a* ready to selectively open and close the other end of the passage 33. The other end of the passage 33 forms an air bleed similar to that employed in the embodiment of FIG. 1.

An adjustment screw is provided as at 34 in a known manner to control the flow rate of fuel to be jetted into the intake passage 10 through the idle port 31.

It will be readily seen that displacement of the diaphragm member 13 of the valve assembly 12 is effected in the manner as hereinbefore described in connection with the embodiment of FIG. 1 and when the pressure inside the first chamber 12*a* is higher than the pressure inside the second chamber 12*b*, the valve piece 14*a* is held in position to permit air to enter the passage 33. Air thus entering into the passge 33 admixes with the fuel passing through the passage 30 towards the low speed port 32 during low speed operation or towards the idle port 31 during idling so that the richness of the fuel can be reduced. Even though the air-fuel mixture at the upstream side of the opening of the discharge passage 19 is made leaner as compared with the required value, the final air-fuel mixture can attain the predetermined ratio because of the addition of vaporized fuel fed into the intake passage 10 through the discharge passage 19.

The method of controlling the amount of fuel available from the idle port 31 or the low speed port 32 in the embodiment of FIG. 3 is substantially similar to that in the embodiment of FIG. 1. However, a method similar to that in the embodiment of FIG. 2 can be employed, which is illustrated in FIGS. 4 and 5.

Referring first to FIG. 4, the idle adjustment screw 34 is provided with a guide bore 34*a* extending in a coaxial manner along the longitudinal axis thereof.

The control valve mechanism 11 comprises a diaphragm valve assembly 40 having first and second chambers 40*a* and 40*b* divided by a diaphragm member 41 within a valve casing. The diaphragm valve assembly 40 includes an adjustment screw 42 threadably extending through the valve casing with the opposite ends respectively situated inside and outside the first chamber 40*a*, and a piston rod 43 having one end rigidly connected to the diaphragm member 41 and a substantially intermediate portion thereof slidably extending through the second chamber 40*b* and then through the valve casing. This valve assembly 40 is secured to the head portion of the idle adjustment screw 34 with the other end portion of the piston rod 43 slidably accommodated within the guide bore 34*a* in the idle adjustment screw 34.

The first chamber 40*a* is in communication with the condensing tank 18 through the control passage 16 while the second chamber 40*b* is in communication with the atmosphere through an opening 40*c* and accommodates therein a spring element 44, for example, a compression spring loosely mounted around the piston rod 43, for biasing the diaphragm member 40 toward the tip of the adjustment screw 42.

It should be noted that one or both of the spring element 44 and the adjustment screw 42 may be omitted if the diaphragm member 41 is made of elastically deformable material. However, even if the diaphragm member 41 is made of elastically deformable material, the use of the adjustment screw 42 is advantageous in that the valve assembly 40 substantially functions an automatically and manually operable, idle adjustment screw, in which case the adjustment screw 34 may also be omitted.

In the arrangement so far described, it will readily be seen that increase of the pressure inside the first chamber 40*a* to a value greater than that in the second chamber 40*b* causes the piston rod 43 to move against the spring element 44 with the free end of said rod 43 regulating the opening of the idle port 31. Therefore, the amount of fuel available from the idle port 31 can be controlled in response to the pressure of fuel vapor inside the fuel tank 17.

The control valve mechanism according to the embodiment of FIG. 4 can operate particularly during idling.

In the embodiment shown in FIG. 5, instead of the use of the passage 33 and the valve piece 14*a* which have been described in connection with the embodiment of FIG. 3, a needle valve 50 connected to the diaphragm member 13 through a connecting rod 51, and a guide bore 52 are employed. The valve assembly 12 in the embodiment of FIG. 5 functions in the same way as that in the embodiment of FIG. 2, except for the difference in that the needle valve 50 is slidably accommodated in the guide bore 52 so as to vary the cross sectional area of the idle and low speed fuel passage 30.

From the foregoing description, it has now become clear that the final air-fuel mixture to be supplied to the combustion chambers of an internal combustion engine can be adjusted to appropriate ratio and amount in response to the pressure of fuel vapor in the fuel tank. More specifically, according to the embodiments shown in FIGS. 1 and 2, the final air-fuel mixture ratio can be controlled by regulating the amount of fuel, which is to be jetted into the intake passage through the main fuel discharge nozzle, in response to variation of the fuel vapor pressure inside the fuel tank. On the other hand, according to the embodiments shown in FIGS. 3 to 5, the final air-fuel mixture ratio can be controlled by regulating the amount of fuel, which is to be jetted into the intake passage through one or both of the low speed port and the idle port, in response to variation of the fuel vapor pressure inside the fuel tank.

Advantages of the control system according to the present invention reside not only in that the unburned compounds present in the exhaust gases can be reduced with economical and efficient combustion taking place in the internal combustion engine, but also in that unnecessary increase of the engine rotational speed can be avoided because of maintenance of the properly adjusted air-fuel mixture ratio and amount.

Although the present invention has been fully described in conjunction with the preferred embodiments thereof, it should be noted that various changes and modifications will be apparent to those skilled in the art. By way of example, the control system of the present invention can effectively be applied in an internal combustion engine of a fuel injection type. In addition, any of the embodiments of FIGS. 1 and 2 and any of the embodiments of FIGS. 3 to 5 can be utilized in a combined manner. Moreover, although in the foregoing embodiments the condensing tank 18 has been described as employed, it may not always necessary in which case the passages 19 and 16 are directly coupled to the fuel tank 17. The orifice 19*a* which acts to determine the handling capacity of the condensing tank 18, or the fuel tank 17 if the tank 18 is not employed, in such a way to avoid breakage of the tank 18 or 17 by the effect of excessively high vapor pressure, may also be omitted if the opening of the passage 19 facing the intake passage 10 is sufficiently narrow.

Therefore, such changes and modifications should be construed as included within the scope of the present invention unless they depart therefrom

What is claimed is:

1. In combination, an internal combustion engine having at least one combustion chamber and an intake conduit means communicating between a source of air and said one combustion chamber, and having a throttle valve in said intake conduit means; a fuel tank means having a space in which fuel which has vaporized can collect, and fuel supply means having fuel passage means connected to said fuel tank for receiving fuel from said fuel tank and connected to said intake conduit means or the combustion chamber for feeding fuel in response to the engine operating condition; and a fuel control system comprising: vapor discharge means connected between said intake conduit means downstream of said throttle valve and said space in said fuel tank means for supplying vaporized fuel from said space directly to said intake conduit means; control passage means; and a diaphragm valve assembly having a diaphragm member defining first and second working chambers, said first chamber being in communication with one of the ends of said control passage means, the other end of said control passage means being in communication with the space in said fuel tank, said second chamber being in communication with the atmosphere, and a valving rod having one end connected to said diaphragm member and the other end situated in said fuel passage means, said valving rod being movable by movement of said diaphragm when the pressure inside said first chamber exceeds a predetermined value for controlling the flow in said fuel passage means.

2. The combination as claimed in claim 1 wherein said fuel passage means comprises fuel discharge passage means and said other end of said valving rod is situated in said fuel discharge passage means and adjusts the cross-sectional area of said fuel discharge passage means.

3. The combination as claimed in claim 1 wherein said fuel passage means comprises air bleed means and said other end of said valving rod is situated in said air bleed means and adjusts the opening area of said air bleed means.

4. The combination as claimed in claim 1 wherein said fuel passage means comprises a main fuel passage means and said other end of said valving rod is situated in said main fuel passage means and adjusts the cross-sectional area of said main fuel passage means.

5. The combination as claimed in claim 1 wherein said fuel passage means comprises a low speed fuel passage means and said other end of said valving rod is situated in said low speed fuel passage means and adjusts the cross-sectional area of said low speed fuel passage means.

6. The combination as claimed in claim 5 wherein said low speed fuel passage means comprises low speed air bleed means and said other end of said valving rod is situated in said low air bleed means and adjusts the opening area of said air bleed means.

7. The combination as claimed in claim 5 wherein said low speed fuel passage means comprises idle fuel passage means and said other end of said valving rod is situated in said idle fuel passage means and adjusts the cross-sectional area of said idle fuel passage means.

8. The combination as claimed in claim 1 wherein said other end of said valving rod is tapered toward the axis of said valving rod.

* * * * *